US005755567A

United States Patent [19]

Licht et al.

[11] Patent Number: 5,755,567

[45] Date of Patent: May 26, 1998

[54] LOW VORTEX SPIN VANES FOR BURNERS AND OVERFIRE AIR PORTS

[75] Inventors: Morten Licht, Canton; Robert J. Giammaruti; Steven A. Thoma, both of North Canton, all of Ohio

[73] Assignee: The Babcock & Wilcox Company, New Orleans, La.

[21] Appl. No.: 604,213

[22] Filed: Feb. 21, 1996

[51] Int. Cl.[6] ..... F23M 9/00

[52] U.S. Cl. ..... 431/183; 431/9; 431/184; 415/90; 415/76

[58] Field of Search ..... 431/183, 9, 184; 110/22, 28, 104, 261, 264; 415/90, 76

[56] References Cited

U.S. PATENT DOCUMENTS

| | | | |
|---|---|---|---|
| 1,066,988 | 7/1913 | Boutwell . | |
| 1,602,180 | 10/1926 | Stillman . | |
| 1,910,893 | 5/1933 | Frisch . | |
| 2,044,296 | 6/1936 | Hardgrove | 110/22 |
| 2,046,767 | 7/1936 | Campbell | 110/22 |
| 2,097,078 | 10/1937 | Peabody | 158/1.5 |
| 2,112,888 | 4/1938 | Greenawalt | 158/77 |
| 2,325,318 | 7/1943 | Hendrix | 110/104 |
| 2,380,463 | 7/1945 | Poole | 110/104 |
| 2,414,459 | 1/1947 | Fletcher | 158/1.5 |
| 2,515,813 | 7/1950 | Wiant | 158/1.5 |
| 2,647,568 | 8/1953 | Sloan | 158/76 |
| 2,669,296 | 2/1954 | Stillman et al. | 158/1.5 |
| 2,676,649 | 4/1954 | Diehl et al. | 158/76 |
| 2,747,657 | 5/1956 | Harvey et al. | 158/73 |
| 2,782,738 | 2/1957 | Zoller | 110/28 |
| 3,049,085 | 8/1962 | Musat et al. | 110/28 |
| 3,179,152 | 4/1965 | Musat et al. | 158/11 |
| 3,198,235 | 8/1965 | Maskell | 158/1.5 |
| 3,299,841 | 1/1967 | Hemker et al. | 110/28 |
| 3,349,826 | 10/1967 | Poole et al. | 158/11 |
| 3,356,122 | 12/1967 | Rackley et al. | 158/1.5 |
| 3,664,757 | 5/1972 | Salisbury et al. | 415/53 |
| 3,720,495 | 3/1973 | Zink et al. | 431/184 |
| 3,904,349 | 9/1975 | Peterson et al. | 431/184 |
| 4,106,890 | 8/1978 | Fulmer et al. | 431/184 |
| 4,160,640 | 7/1979 | Maev et al. | 431/9 |
| 4,181,020 | 1/1980 | Herzl | 73/861.24 |
| 4,255,081 | 3/1981 | Oklejas et al. | 415/90 |
| 4,455,045 | 6/1984 | Wheeler | 296/185 |
| 4,457,241 | 7/1984 | Itse et al. | 110/347 |
| 4,479,775 | 10/1984 | Wiesel | 431/353 |
| 4,500,282 | 2/1985 | Eschenko et al. | 431/184 |
| 4,504,217 | 3/1985 | Winschel et al. | 431/183 |
| 4,519,322 | 5/1985 | Lindstrom et al. | 110/264 |
| 4,602,571 | 7/1986 | Chadshay | 110/264 |
| 4,681,532 | 7/1987 | Chung | 431/183 |
| 4,902,221 | 2/1990 | Collins, Jr et al. | 431/183 |
| 4,927,352 | 5/1990 | Chung | 431/184 |
| 5,092,762 | 3/1992 | Yang | 431/184 |
| 5,101,633 | 4/1992 | Keller et al. | 60/737 |
| 5,112,220 | 5/1992 | Wimberger et al. | 432/8 |
| 5,142,858 | 9/1992 | Ciokajlo et al. | 60/39.33 |
| 5,145,361 | 9/1992 | Kurzinski | 432/19 |
| 5,161,946 | 11/1992 | Bortz et al. | 415/183 |
| 5,199,355 | 4/1993 | Larue | 110/261 |
| 5,207,008 | 5/1993 | Wimberger et al. | 34/23 |
| 5,240,404 | 8/1993 | Hemsath et al. | 431/9 |
| 5,257,927 | 11/1993 | Lang | 431/184 |
| 5,302,115 | 4/1994 | Hagar et al. | 431/183 |

FOREIGN PATENT DOCUMENTS

| | | | |
|---|---|---|---|
| 123905 | 10/1976 | Japan | 416/231 R |
| 754055 | 8/1956 | United Kingdom | 416/231 R |
| 942648 | 11/1963 | United Kingdom | 416/231 R |

OTHER PUBLICATIONS

"Steam/Its Generation and Use", 40th ed., The Babcock & Wilcox Company, pp. 13–3 to 13–11, 1992.

*Primary Examiner*—Larry Jones

*Attorney, Agent, or Firm*—Robert J. Edwards; Robert P. Bennett; Eric Marich

[57] ABSTRACT

A spin vane for burners and over fire air ports in a furnace comprise a sheet-like vane element having a base and an extension extending perpendicularly off the base on the low pressure side of the vane element. The extension reduces the formation and propagation of vortices on the low pressure side of the vane, increasing flow efficiency and reducing pressure loss across the spin vanes.

2 Claims, 2 Drawing Sheets

LOW VORTEX SPIN VANES FOR BURNERS AND OVERFIRE AIR PORTS

BACKGROUND OF THE INVENTION

1. Field of the Invention

The present invention relates in general to furnace burners, and in particular to a new and useful spin vane for burners and air ports.

2. Description of the Related Art

A key feature of burners and overfire air (OFA) ports used in industrial and utility boilers is the spin vanes in the secondary (or combustion) air zones. These spin vanes change the flow direction of the incoming secondary air by imparting swirl to the air as it exits the burner or OFA port. The spin vanes are located in the annular flow passage(s) that surround the burner fuel nozzle or the OFA port core air flow passage. The vanes are fabricated from flat plate material and are designed to be adjusted from a completely closed to a fully open position in the annular flow passage.

FIG. 1 illustrates the Babcock & Wilcox (B & W) DRB-XCL burner 10 with adjustable spin vanes 12, 14 in both the inner and outer air zones that are annular around burner nozzle 18. Fixed spin vanes 22 are also shown in the outer air zone of the burner. A conical diffuser 16 is in burner nozzle 18 that is supplied by primary air and pulverized coal at 24. Air flow to the inner and outer air zones can be controlled by damper 20.

U.S. Pat. No. 1,602,180 discloses angled vanes with a projecting flange. However the flange is not placed in a flow path and is fixed to the vane for support purposes, not for flow direction.

U.S. Pat. No. 2,647,568 discloses vanes or ribs, which are inclined relative to the burner's axis. The ribs have flared and contoured surfaces but these do not have an extension perpendicular to part of the length.

U.S. Pat. No. 2,515,813 is a further example of angled vanes without an extension.

U.S. Pat. No. 3,049,055 patent discusses optimum vane angularity.

As shown in FIG. 2, the low pressure backside or leeward side of a conventional spin vane 34 receiving a flow of air in direction F, experiences ever growing vortices V, which propagate along the surface and are shed past the downstream edge of the vane. As shown in FIG. 3, vortices V are formed which disturb the air on the low pressure side of the vane. The creation of large vortices V reduces the efficiency of the air spinning ability of the spin vanes and increases pressure drop across the spin vanes.

SUMMARY OF THE INVENTION

The present invention relates to a novel spin vane of the type used in air flow passages of burners and overfire air ports. More particularly, a perpendicular extension is added to the base of the spin vane and is offset, in accordance with a specified formulation, from the leading edge of the spin vane. There is also a specified ratio of width to length (h/l) of the extension that is proportional to a spin vane height-to-length (H/L) ratio range. The structure of the invention reduces the vortex otherwise formed along the base of the vane.

Accordingly, an object of the present invention is to provide a low vortex spin vane for an air passage of a burner and/or overfire air port comprising:

A plate-like spin vane element having a base, leading and trailing edges and an outer edge; and an extension fixed to the vane element and extending substantially transversely from the base of the vane element on a low pressure side of the vane element for reducing the formation and propagation of vortices along the low pressure side of the vane when the vane is in a flow of gas passing from the leading to the trailing edge of the vane element.

Another object of the invention is to provide a vane element which reduces vortices and increases efficiency and which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
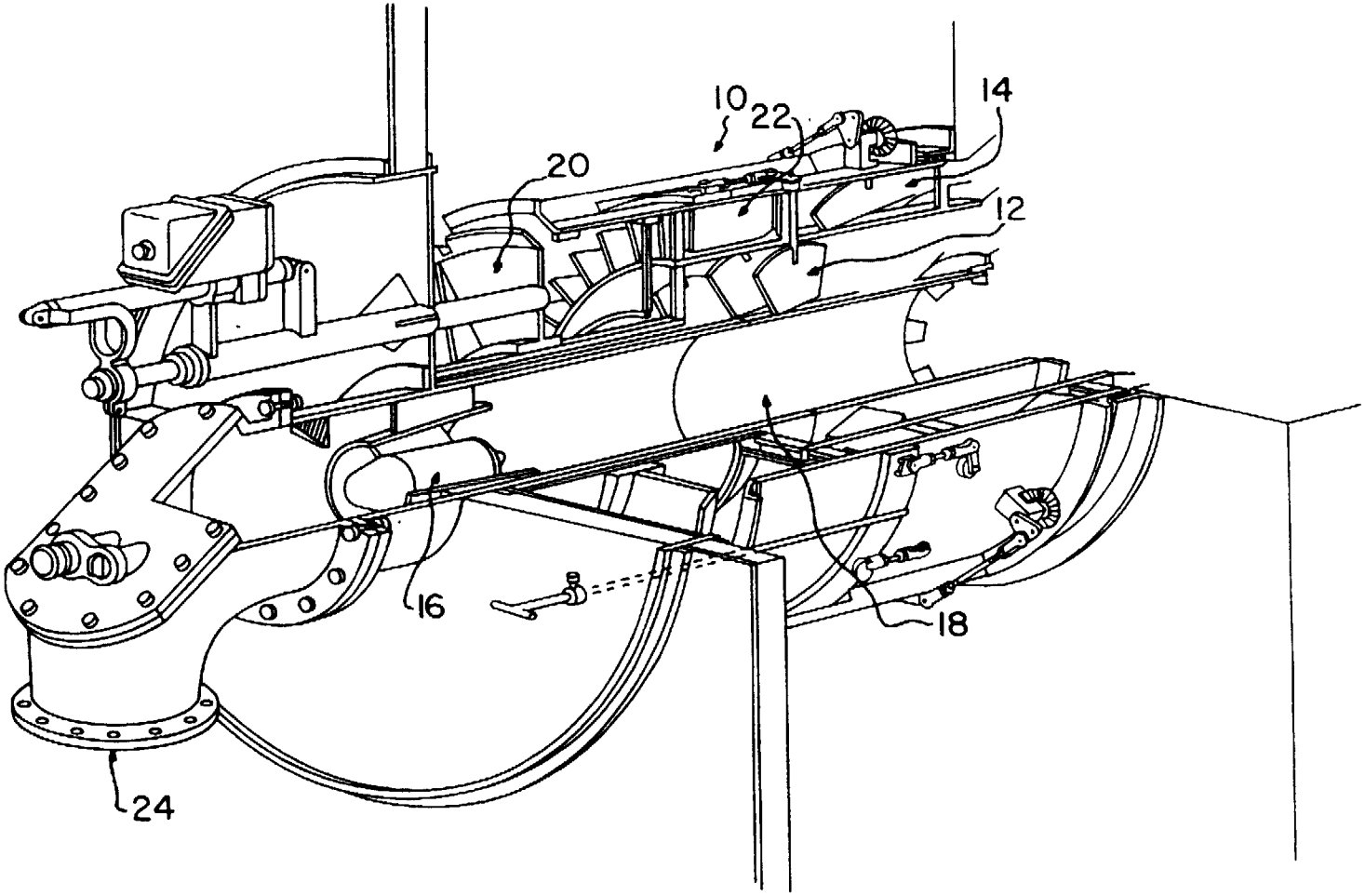
FIG. 1 PRIOR ART
FIG. 1 is a perspective fragmentary view of a known Babcock & Wilcox burner which uses spin vanes of conventional design.
Figure 2:
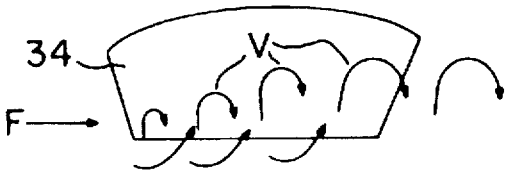
FIG. 2 PRIOR ART
FIG. 2 is a low pressure side elevational view of a known spin vane.
Figure 3:
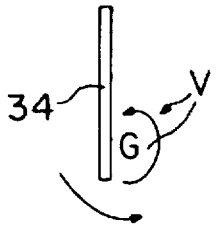
FIG. 3 PRIOR ART
FIG. 3 is a front elevational view of a known spin vane.
Figure 4:
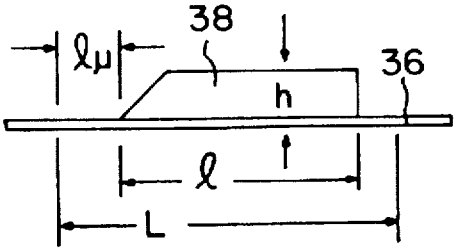
FIG. 4 is a bottom plan view of a spin vane constructed according to the invention.
Figure 5:
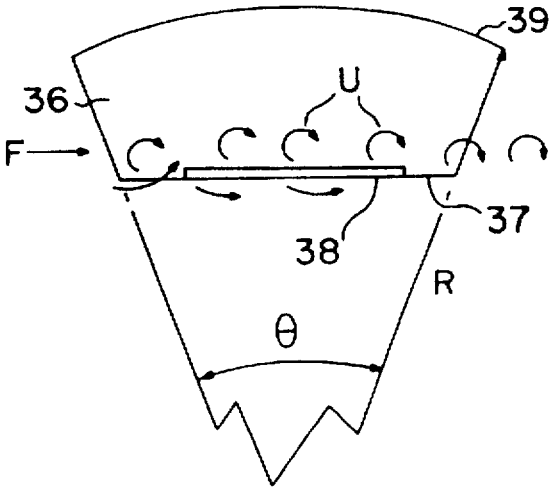
FIG. 5 is a low pressure side elevational view of the spin vane of the invention.
Figure 6:
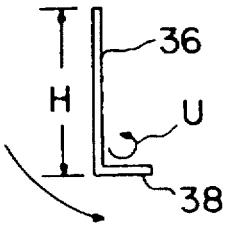
FIG. 6 front elevational view of the spin vane of the invention.

The present invention as shown in FIGS. 4 to 6, involves adding an extension 38 to the base 37 of a spin vane 36 used in the air flow passages of burners and OFA ports. The extension is located with an offset lu from the leading edge of the spin vane. This offset eliminates any mechanical interference that would prevent the spin vanes from being fully closed. The ratio of the width (h) to the length (l) of the extension is proportional to spin vanes having height-to-length (H/L) ratios ranging from 0.43 to 0.80.

The problem solved by the invention is the reduction in size of the vortex U formed along the base of the spin vanes when they are rotated at an angle to the flow direction F. A vortex is formed along the base of a spin vane as secondary air flows from the high pressure front side to the low pressure back side. The size of the vortex is small near the leading edge of the spin vane and increases as additional air is supplied along the length of the spin vane's base.

The extension 38 reduces the quantity of secondary air flowing around the spin vane's base, thus reducing the size of the vortex. A reduction in the size of the vortex increases the flow area between the spin vanes and results in a pressure drop reduction. Test results show a pressure reduction of 10% can be achieved. In addition, the efficiency at which the invention imparts swirl to the flow is improved by the reduction in the size of the vortex. The radius of curvature R of the top edge 39 of vane 36 is selected to fit in the air flow passage of the burner, as are the leading and trailing edges at angle $\Theta$ (theta).

While a specific embodiment of the invention has been shown and described in detail to illustrate the application of the principles of the invention, it will be understood that the invention may be embodied otherwise without departing from such principles.

What is claimed is:

1. A plate-like spin vane element having a straight base of length L and height H, leading and trailing edges at an acute angle to each other, an outer curved edge, and an extension fixed to the spin vane element, wherein the extension is offset from the leading edge, has a length l less than the length L of the base, and is substantially centered and extends substantially transversely and perpendicularly from the base of the spin vane element on a low pressure side of the spin vane element for reducing the formation and propagation of vortices along the low pressure side of the spin vane element when the spin vane element is in a flow of gas passing from the leading to the trailing edge of the spin vane element.

2. The plate-like spin vane element according to claim 1, wherein a ratio of the width h to the length l of the extension is proportional to a ratio of the height H to the length L of the spin vane element ranging from 0.43 to 0.80.

* * * * *